US008449947B2

(12) United States Patent
Grynaeus et al.

(10) Patent No.: US 8,449,947 B2
(45) Date of Patent: May 28, 2013

(54) THERMAL CONTROL NONWOVEN MATERIAL

(75) Inventors: Peter Grynaeus, DBirkenau (DE); Duncan Russell, Greensboro, NC (US); Terry O'Regan, Chapel Hill, NC (US); David S. Dietel, Kernersville, NC (US); Susan Gwynneth Johnson, Leicester (GB)

(73) Assignee: Carl Freudenberg KG, Weinheim (DE)

( * ) Notice: Subject to any disclaimer, the term of this patent is extended or adjusted under 35 U.S.C. 154(b) by 634 days.

(21) Appl. No.: 11/799,551

(22) Filed: May 1, 2007

(65) Prior Publication Data

US 2007/0212967 A1 Sep. 13, 2007

Related U.S. Application Data

(63) Continuation of application No. 10/343,720, filed as application No. PCT/US01/41497 on Jul. 31, 2001, now abandoned, which is a continuation-in-part of application No. 09/699,744, filed on Oct. 30, 2000, now abandoned, and a continuation-in-part of application No. 09/750,212, filed on Dec. 28, 2000, now abandoned.

(60) Provisional application No. 60/231,040, filed on Sep. 8, 2000.

(30) Foreign Application Priority Data

Aug. 5, 2000 (GB) ..... 0019142.9

(51) Int. Cl.
*B05D 3/02* (2006.01)

(52) U.S. Cl.
USPC ..... 427/389.9; 427/392; 427/394; 427/396; 427/430.1

(58) Field of Classification Search
None
See application file for complete search history.

(56) References Cited

U.S. PATENT DOCUMENTS

| | | | |
|---|---|---|---|
| 3,059,313 | A | 10/1962 | Harmon |
| 3,427,250 | A | 2/1969 | Howard |
| 4,056,478 | A | 11/1977 | Capelli |
| 4,152,784 | A | 5/1979 | McGalliard |
| 4,201,822 | A | 5/1980 | Cowsar |
| 4,446,177 | A | 5/1984 | Munoz et al. |

(Continued)

FOREIGN PATENT DOCUMENTS

| | | |
|---|---|---|
| CA | 1182067 | 2/1985 |
| CA | 1182068 | 2/1985 |

(Continued)

OTHER PUBLICATIONS

Abstracts and partial machine translation of JP 05-156570, Jun. 1993.*

(Continued)

*Primary Examiner* — Erma Cameron
(74) *Attorney, Agent, or Firm* — Pearl Cohen Zedek Latzer, LLP

(57) ABSTRACT

A nonwoven textile having reversible enhanced thermal control properties, the material comprising: a bat or web bonded by polymeric binder containing thermal control material within the interior of the bat or web, wherein the thermal control material is dispersed throughout the interior of the polymeric binder, and wherein the thermal control material is substantially entirely within the interior of the nonwoven textile.

22 Claims, 2 Drawing Sheets

U.S. PATENT DOCUMENTS

| | | | | |
|---|---|---|---|---|
| 4,504,402 | A | | 3/1985 | Chen et al. |
| 4,524,529 | A | | 6/1985 | Schaefer |
| 4,556,439 | A | | 12/1985 | Bannink, Jr. |
| 4,600,605 | A | | 7/1986 | Nakai et al. |
| 4,618,524 | A | | 10/1986 | Groitzsch et al. |
| 4,623,575 | A | | 11/1986 | Brooks et al. |
| 4,748,044 | A | | 5/1988 | Fottinger et al. |
| RE32,713 | E | | 7/1988 | Woo |
| 4,756,958 | A | * | 7/1988 | Bryant et al. ..... 428/320.2 |
| 4,774,133 | A | | 9/1988 | Doree et al. |
| 4,820,575 | A | | 4/1989 | Kolzer |
| 4,882,220 | A | | 11/1989 | Ono et al. |
| 4,939,020 | A | * | 7/1990 | Takashima et al. ..... 428/220 |
| 5,000,090 | A | | 3/1991 | Telc et al. |
| 5,126,061 | A | | 6/1992 | Michael |
| 5,156,843 | A | | 10/1992 | Leong et al. |
| 5,232,769 | A | * | 8/1993 | Yamato et al. ..... 442/123 |
| 5,366,801 | A | * | 11/1994 | Bryant et al. ..... 442/131 |
| 5,532,039 | A | | 7/1996 | Payne et al. |
| 5,637,389 | A | | 6/1997 | Colvin et al. |
| 5,677,049 | A | | 10/1997 | Torii |
| 5,722,482 | A | | 3/1998 | Buckley |
| 5,851,338 | A | | 12/1998 | Pushaw |
| 6,004,662 | A | | 12/1999 | Buckley |
| 6,077,597 | A | * | 6/2000 | Pause ..... 428/218 |
| 6,197,415 | B1 | * | 3/2001 | Holman ..... 428/314.4 |
| 6,207,738 | B1 | | 3/2001 | Zuckerman et al. |
| 6,514,362 | B1 | * | 2/2003 | Zuckerman et al. ..... 156/79 |
| 6,517,648 | B1 | | 2/2003 | Bouchette et al. |
| 6,607,994 | B2 | * | 8/2003 | Soane et al. ..... 442/59 |
| 6,613,704 | B1 | | 9/2003 | Arnold et al. |
| 6,685,746 | B1 | | 2/2004 | Painter |
| 6,981,341 | B2 | | 1/2006 | Baychar |
| 7,036,197 | B2 | | 5/2006 | Zafiroglu et al. |
| 2002/0034910 | A1 | * | 3/2002 | Johnson ..... 442/375 |
| 2002/0132091 | A1 | * | 9/2002 | Worley ..... 428/138 |
| 2005/0227047 | A1 | | 10/2005 | Sutter et al. |

FOREIGN PATENT DOCUMENTS

| | | | |
|---|---|---|---|
| CA | 2 137 554 | | 12/1993 |
| CH | 446259 | | 3/1968 |
| DE | 1 127 320 | | 4/1962 |
| DE | 29 14 617 | | 10/1980 |
| DE | 19510793 | | 8/1996 |
| DE | 69316027 | | 5/1998 |
| EP | 0123794 | | 11/1984 |
| EP | 0178372 | | 4/1986 |
| EP | 0190788 | | 8/1986 |
| EP | 0 222 399 | | 5/1987 |
| EP | 0361338 | | 4/1990 |
| EP | 0611330 | | 1/1998 |
| GB | 2073613 | A | 10/1981 |
| GB | 2334428 | | 8/1999 |
| JP | 57-128248 | A | 8/1982 |
| JP | 63-035865 | A | 2/1988 |
| JP | 64-085374 | | 3/1989 |
| JP | 03213556 | A | 9/1991 |
| JP | 05-156570 | | 6/1993 |
| JP | 07003596 | A | 1/1995 |
| JP | 07-070943 | | 3/1995 |
| JP | 07070902 | A | 3/1995 |
| JP | 10-502137 | | 2/1998 |
| KR | 10-0820034-0000 | | 4/2008 |
| KR | 10-0890322-0000 | | 3/2009 |
| WO | 93/24241 | | 12/1993 |
| WO | WO 93/24241 | | 12/1993 |
| WO | WO95/34609 | * | 12/1995 |
| WO | WO 95/34609 | | 12/1995 |
| WO | 00/56940 | | 9/2000 |
| WO | WO 01/06054 | | 1/2001 |
| WO | WO 01/92010 | | 6/2001 |
| WO | WO 02/12607 | | 2/2002 |
| WO | WO 02/12607 | A2 | 2/2002 |
| WO | WO 02/059414 | | 8/2002 |
| WO | 02/092911 | | 11/2002 |
| WO | WO 02/095314 | | 11/2002 |
| WO | WO 03/056086 | | 7/2003 |
| WO | WO 03/056088 | A1 | 7/2003 |
| WO | WO 2005005704 | A2 | 1/2005 |

OTHER PUBLICATIONS

Abstracts and translation of JP 05-156570, Jun. 1993.*

Papers from *Outlast* v. *Frisby*, Civil Action No. 01-F-1882 (CBS)(BNB) (District of Colorado), related to certain above-cited US Patent Documents, including: Order on Cross Motions for Partial Summary Judgment, filed Jan. 4, 2004; Brief in Support of Defendant's Motion Under Rule 56, FRCP, for Partial Summary Judgment of Non-Infringement and in Opposition to Plaintiff's Motion for a Preliminary Injunction; Frisby's Reply Brief in Support of Its Motion for Partial Summary Judgment of Non-Infringement; Declaration of Rory A. Holmes; Deposition of Dr. Peter J. Hauser; Plaintiff's Motion for Partial Summary Judgment Under FRCP 56 That Defendant Is Infringing US Patent No. 5,366,801 and Memorandum of Law in Support of Same.

Abstract of Knitting International, 99(1184), pp. 42-43, 1992.

Smith, Textile World, 145(10), pp. 69+3, 1995.

Abstract of Lennox-Kerr, Technical Textiles International, 7(6), pp. 25+2, 1998.

Office Action, in counterpart CA application 2,417,876, mailed Oct. 10, 2006.

Supplementary European Search Report in counterpart app EP 01 964 553.0 (dated Apr. 10, 2008).

EPO Communication in counterpart app EP 01 964 553.0 (dated Jul. 28, 2008).

International Search Report dated Aug. 9, 2006 issued in International Patent Application No. PCT/EP2006/003954.

Non-Final Office Action issued for U.S. Appl. No. 11/994,071, mailed on Apr. 29, 2011.

English Translation of Office Action issued for Japanese Application No. 2002-517882, mailed on Feb. 22, 2011.

Notice of Allowance issued for U.S. Appl. No. 11/994,071, mailed on Oct. 13, 2011.

* cited by examiner

THERMAL CONTROL NONWOVEN MATERIAL

CLAIM FOR PRIORITY

This application is a continuation of U.S. application Ser. No. 10/343,720, filed Aug. 13, 2003, which is a U.S. National Phase application of PCT/US01/41497, filed Jul. 31, 2001, which claims the benefit under 35 USC 119 of United Kingdom application serial no. 0019142.9 filed Aug. 5, 2000, and the benefit under 35 USC 119(e)(1) of U.S. application Ser. No. 60/231,040, filed Sep. 8, 2000, now expired; this application is a continuation-in-part of U.S. application Ser. No. 09/699,744, filed Oct. 30, 2000, now abandoned; and this application in a continuation-in-part of U.S. application Ser. No. 09/750,212 filed Dec. 28, 2000, now abandoned. The disclosures of each of the above are hereby incorporated by reference.

FIELD OF THE INVENTION

This invention relates to nonwoven materials useful as components of garments that protect against cold or hot environmental conditions. More particularly, the invention relates to articles that employ phase change materials to absorb and release heat. For example, the invention relates to shoe insoles and lining materials for maintaining the thermal climate in an enclosed shoe.

BACKGROUND OF THE INVENTION

Fibrous products coated with phase change material are known. For example, publications and patents including the following disclose these and related products: U.S. Pat. No. 6,077,597 to Pause, which discloses a three layer insulating system. The first layer is a flexible substrate treated with a coating in which are dispersed microspheres containing a phase change material. The second layer is a mat of fibers in which are dispersed microspheres containing a phase change material. The third layer is a flexible substrate. U.S. Pat. No. 4,939,020 to Takashima et al. discloses a non-woven fabric with a coating composition comprising a vinyl polymer, heat-expandable microcapsules, and a thiocyanate compound. U.S. Pat. Nos. 5,722,482 and 6,004,662 to Buckley discloses flexible composite material containing phase change material. PCT application WO 95/34609 to Gateway Technologies discloses fabric coatings including phase change material dispersed throughout a polymer binder, surfactant, dispersant, antifoam agents and thickener. U.S. Pat. No. 5,366,801, and EP application 611,330 B1 to Bryant et al. disclose articles including fabric and fiber base material coated with polymeric binder and microcapsules. U.S. Pat. No. 4,756,958 to Bryant et al. discloses fiber with integral microspheres filled with phase change material.

SUMMARY OF THE INVENTION

The invention results from the discovery that novel combinations and configurations of materials can be used to create nonwoven thermal control textiles providing protection against either hot or cold conditions. The nonwoven textile can be a multiple-use article, suitable for incorporation as an interlining into garments such as jackets, pants, shirts, overalls, hats, scarves, and the like, as well as in footwear such as shoes and boots. For example, a shoe insole or lining can be created that helps to maintain the thermal climate within the shoe more effectively than with conventional materials or methods. The nonwoven can be used as linings in suitcases, and bags. The nonwoven can be used to produce medical garb.

"Nonwoven" as used herein in its customary sense, refers to fabric that, in contrast to woven or knitted fabric, comprises bonded continuous or staple fiber. The term "shoe," as used herein, is to be understood as denoting outer footwear generally.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Other features and advantages of the invention will be apparent from the following detailed description, and from the claims.

DETAILED DESCRIPTION

Figure 1:
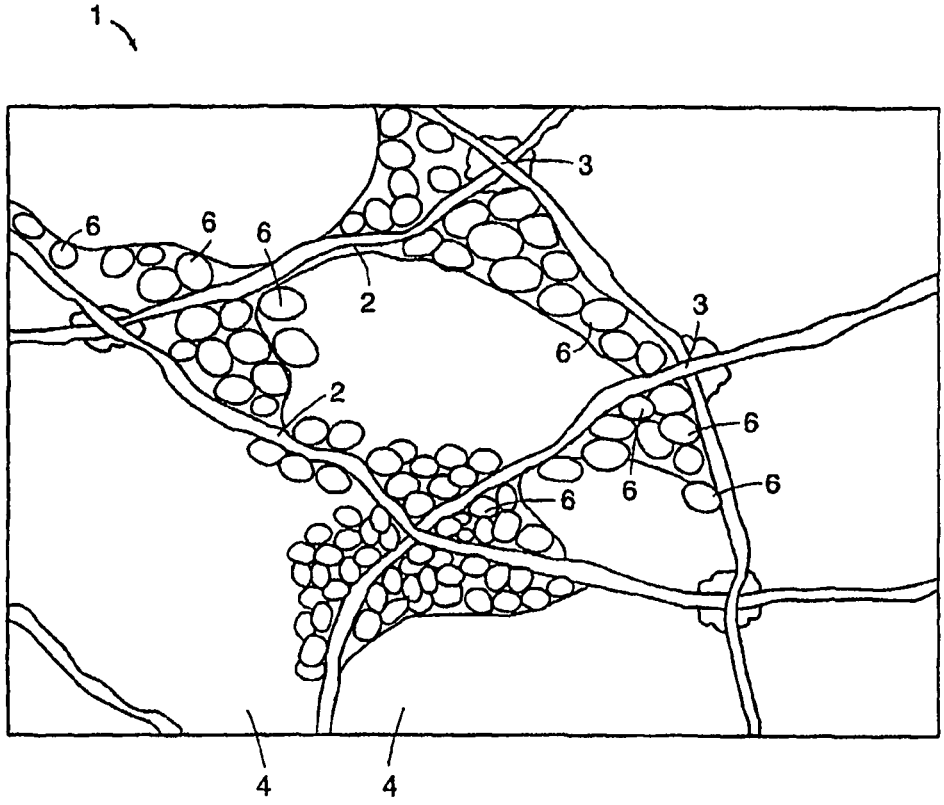
FIG. 1 is a schematic illustration of a nonwoven web material according to a particular embodiment of the invention.

The thermal control nonwoven material has a polymeric binder dispersed throughout its interior, and thermal control material dispersed throughout the interior of the binder. The binder in the nonwoven may be a continuous filling or it may be discontinuous, as will be explained. The thermal control nonwoven material according to this invention has the ability to protect against hot or cold environments, by virtue of the absorption and/or release of heat from the thermal control material.

The nonwoven textiles can be made up of a wide variety of substances. For example, the nonwoven can be formed from cellulosic, polyolefin (for example, polyethylene, polypropylene and the like), polyesters, polyamides (for example, nylon), bi-component materials or mixtures of the above, and even inorganic fibers. These fibers can be of lengths between about 0.3 and about 7 cm, depending on the method of web formation and bonding desired, alternatively, the fibers can be longer, including a fiber or fibers prepared by continuous extrusion of a melted polymer via spunbond/meltblown technology. Fibers can range from about 0.5 to about 30 denier.

Nonwoven textiles are prepared in two distinct steps: the first step is formation of a loose bat or web, and the second is bonding of the bat or web, for example by binder, or physical fusion of the bat or web at its junctions, or entanglement of the bat or web to create a nonwoven.

Web formation can be carried out according to any of the methods known in the art. For example, the web can be made by a dry-laid process, in which rotating rollers having fine teeth along their circumferences are used to card individual fibers into a substantially parallel-laid, or unidirectional, web. Such unidirectional webs can be combined by crosslapping, in which individual unidirectional webs are built up at an angle to each other. For a further example, the web can be made by a wet-laid process, in which fibers are dispersed in water and passed over a belt screen. The water is extracted through the screen, and the resulting web is formed on the belt. This method produces a dense, uniform and strong web. Random-laid (isotropic) webs can be created by air deposition, which involves blowing fibers randomly onto a screen. In another embodiment, fibers can be laid randomly onto a preformed nonwoven scrim, which takes the place of a screen. For example, fibers could be blown onto a preformed web having binder with thermal control material dispersed within the binder, to form a bi-layered product with one layer having thermal control properties, and another layer without such properties. For example, such a product could be made with one layer of approximately 200 g/m2 of nonwoven including thermal control material, and another layer of approximately 200-800 g/m2 of nonwoven having been blown onto the thermal control nonwoven.

Random-laid webs can be created also by melt-blowing processes, where fibers are directly spun from a polymer, drawn and torn to varying lengths by the air stream, and deposited to form a substrate. Alternatively, spunbonding can be used to create virtually endless fibers from granules of raw material. The fibers are stretched by (heated air) and laid into a web. These processes produce nonwoven fabrics in a single, continuous process.

For insole constructions, the nonwoven can take a number of forms. The type of material used depends on the required end use of the material. For an insole material, the non-woven fabric preferably comprises a stiff, rigid board, formed, for example, from a blend of polyester fibers with a range of decitex values with a stiff polymer binder. For a cushion-type insole, the nonwoven fabric preferably comprises, for example, a blend of coarse polyester fibers having a decitex value of about 6, with a soft, resilient polymer binder to give a material having a resilient and open structure.

After formation of the web, and in some embodiments, after any eventual slight prebonding of the web (to be described below), the web is submerged in a bath containing a suspension or dispersion of polymeric binder and thermal control material. According to the processes described herein, a nonwoven is created in which the web is bonded to itself by binder, at least at points of intersection. In some embodiments, the web is substantially continuously filled with polymeric binder, while in other embodiments, the polymeric binder is present substantially at the web junctions, and the interstices are substantially filled with a gas, such as air. Binders useful in fabrics of this invention are solids at temperatures of fabric use, preferably resulting in nonwoven which are washable and dry cleanable. If a solvent is used, the binder can have a high melting point. If not dissolved, however, suitable binders generally flow below the softening point of the base material of the web. Some suitable binders are polymeric materials. Particularly useful are polymer dispersions or emulsions which are able to form adhesive and/or cohesive bonds within the web, for example by crosslinking to itself, or by crosslinking to the web itself. Examples of polymeric binders, include acrylics and polyacrylics, methacrylics and polymethacrylics, polyurethanes, nitrile rubbers, styrene/butadiene copolymers, chloroprene rubbers, polyvinyl alcohols, or ethylene/vinyl acetate copolymers, and mixtures thereof.

Latex binders can also be used, including water-based latex blends. Advantageously, the latex binder comprises a stiff styrene/butadiene rubber latex. Preferably the binder includes a thickener, for example ammonia and an acrylic latex that reacts with the thickener (for example, ammonia) to thicken the mixture. For example, a suitable latex binder comprises a blend of 75% by weight of Applied Polymers S30R and 25% by weight of Synthomer™ 7050. This blend can be thickened with ammonia and an acrylic latex such as, for example, Viscalex™ HV30, manufactured by Allied Colloids.

Examples of thermal control materials include phase-change materials, such as those discussed below.

This submersion step is carried out to the extent necessary to allow substantially complete penetration of the suspension or dispersion into the web. The bath can be heated, in order to effect fusion of the fibers at points of intersection. The web is then dried to remove any solvent (i.e. water), resulting in a nonwoven textile having binder and thermal control material in the interstices of the web material. Alternatively or additionally, the web can be passed through rollers, which can be heated or not heated. Warmed or hot air can also be used to dry the web. In some embodiments, the interstices of the resulting web are substantially filled with binder and thermal control material.

Figure 2:
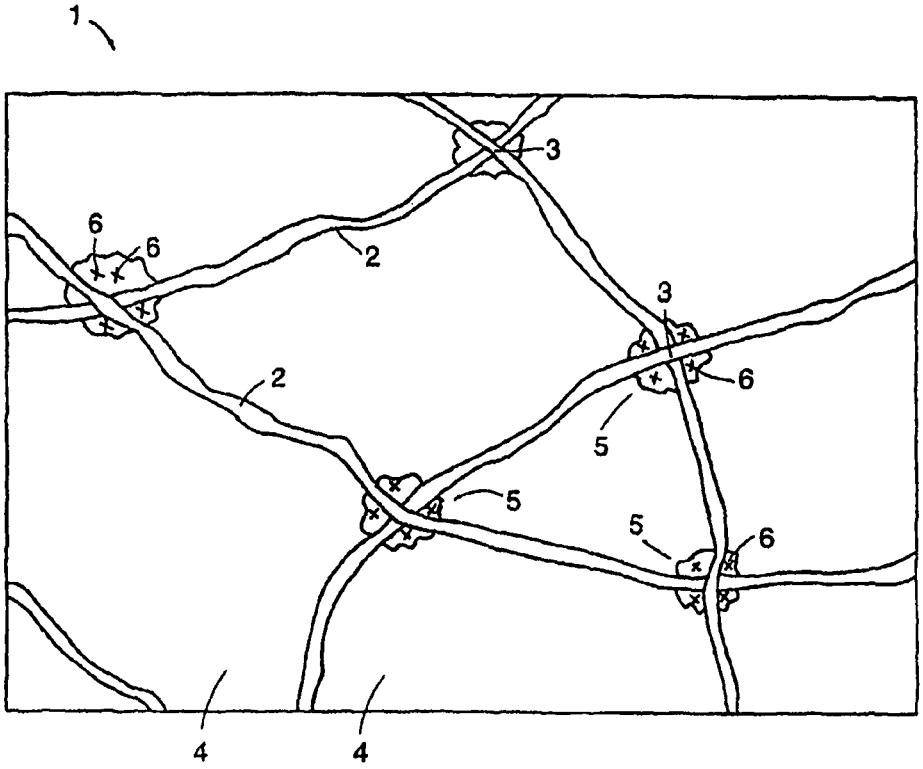
FIG. 2 is a schematic illustration of a nonwoven web material according to another particular embodiment of the invention.

A preferred embodiment of the invention has the binder located almost entirely at points where the web intersects itself, leaving the remainder of the interstices filled with gas, typically air, which imparts thermal insulative properties to the material. Turning to FIGS. 1 and 2, there is shown a portion of nonwoven 1 comprising web material 2, having junctions 3, and interstices or voids 4. Dispersed throughout the web and located at junctions of fibers of the web material are areas of binder 5, having thermal control material 6 dispersed throughout. The remainder of the web does not contain binder, in some embodiments. The binder acts as the bonding agent of the web to itself as well as the bonding agent of the thermal control material to each other and to the web, thus forming a bonded nonwoven with thermal control material dispersed therein.

Nonwoven textiles according to such embodiments can be prepared by utilizing the surface tension of the binder, and the relative affinities of the binder for the web and for itself. A binder which shows excessive self-affinity will not be prone to bind to the web at all, while a binder which shows excessive affinity for the web will not form islands or globules at the web's intersection points. The rate at which any solvent is removed from a binder can also affect the extent to which binder forms islands or globules at the web intersections. Excessively rapid solvent removal may not allow the binder to migrate to the web junctions. It is within the ordinary level of skill of one in the art to select a solvent removal rate which is well matched to the affinity properties of the binder.

In other embodiments, the web is substantially entirely filled with binder, the binder having thermal control material dispersed throughout it. Embodiments in which the web is filled can also call for relatively flexible binder material, or can call for relatively rigid binder material, depending on the application.

The viscosity of the binder can be modulated to produce nonwoven fabric having binder coagulated at the interstices of the web. In such embodiments, the binder coagulates at the interstices of the web, as shown in FIG. 1 and FIG. 2.

The bonding of the web is carried out preferably immediately after web formation, by submersion of the web into binder bath containing the thermal control material. Alternatively slight prebonding processes including binder spray-bonding, thermal bonding processes, needling processes and water-jet bonding processes may be carried out prior to the submersion of the web into the binder bath and final bonding of the nonwoven. These processes can impart various qualities to the finished product, as recognized by those of skill in the art. For example, needling or water-jet bonding can be used to produce relatively dense and stiff nonwovens, as well as relatively light and voluminous nonwovens, depending on the needling or water-jet density and pressure. In some embodiments, a preferred web can be a non-woven needle felt. In another example, spunbonded webs can be submerged in the above-described chemical bath subsequent to their bonding.

The thermal control materials that can be included in the textiles are those suitable for protection against cold and/or heat. Particularly useful thermal control materials include phase change materials. Phase change materials that are encapsulated, particularly microencapsulated, are useful in the invention. Microcapsules suitable for the present invention may contain a wide variety of materials. The choice of materials is limited only by the conditions for processing of the textiles disclosed herein. Microcapsules suitable for the present invention have diameters ranging from 15.0 to 2,000 microns. Preferably, the microcapsules have diameters of from 15 to 500 microns. Most preferably, the microcapsules have diameters of from 15 to 200 microns. Phase change materials are well suited for inclusion in microcapsules, wherein the microcapsules have a diameter of the same order as, or greater than, the diameter of the material making up the nonwoven.

Phase change materials are designed to utilize latent heat absorption associated with a reversible phase change transition, such as a solid-liquid transition. Certain phase change materials also absorb or emit heat upon solid-solid phase transitions. Thus, the material can be used as an absorber of heat to protect an object from additional heat, because a quantity of thermal energy will be absorbed by the phase change material before its temperature can rise The phase change material can also be preheated and used as a barrier to cold, as a larger quantity of heat must be removed from the phase change material before its temperature can begin to drop. The phase change materials which are preferred for the present invention utilize a reversible solid-liquid transition.

Phase change materials store thermal energy in the form of a physical change of state as the core material within the microcapsules melts or freezes or undergoes a solid-solid transition. These materials will absorb or emit heat at a constant temperature (their phase change temperature) before changing phase. Thus, the material can be used as an absorber of heat to protect an object from additional heat as a quantity of thermal energy will be absorbed by the phase change material before its temperature can rise. The phase change material can also be preheated and used as a barrier to cold, as a larger quantity of heat must be removed from the phase change material before its temperature can begin to drop. In order to maintain the ability of the phase change materials to recycle between solid and liquid phases, it is important to prevent dispersal of the phase change materials throughout the solvent (or carrier fluid) when they are in the liquid form. An approach which has found success is encapsulation of the phase change materials within a thin membrane or shell. Such thin membranes or shells should desirably not significantly impede heat transfer into or out of the capsules. The capsules can desirably also be small enough to present a relatively high surface area. This makes rapid heat transfer to and from the carrier fluid possible. Such capsules are known as nicrocapsule. Microcapsule range in size from about 10 to about 50 microns and are formed according to conventional methods well known to those with skill in the art. Heat transfer across the microcapsule material into its interior should be efficient for maximum utility in the present invention.

The composition of the phase change material is modified to obtain optimum thermal properties for a given temperature range. For example, the melting point for a series of paraffinic hydrocarbons (normal, straight chain hydrocarbons of formula CnH2n+2) is directly related to the number of carbon atoms as shown in the following table.

TABLE 1

Hydrocarbon Phase Transition Temperatures

| Compound Name | Carbons | Melting Point (° C.) |
|---|---|---|
| n-decane | 10 | −32 |
| n-undecane | 11 | −26 |
| n-dodecane | 12 | −11 |
| n-tridecane | 13 | −5.5 |
| n-tetradecane | 14 | 5.9 |
| n-pentadecane | 15 | 10.0 |
| n-hexadecane | 16 | 18.2 |
| n-heptadecane | 17 | 22.0 |
| n-octadecane | 18 | 28.2 |
| n-nonadecane | 19 | 32.1 |
| n-eicosane | 20 | 36.8 |
| n-heneicosane | 21 | 40.5 |
| n-docosane | 22 | 44.4 |
| n-tricosane | 23 | 47.6 |
| n-tetracosane | 24 | 50.9 |
| n-pentacosane | 25 | 53.7 |
| n-hexacosane | 26 | 56.4 |
| n-heptacosane | 27 | 59.0 |
| n-octacosane | 28 | 61.4 |
| n-nonacosane | 29 | 63.4 |
| n-triacontane | 30 | 65.4 |
| n-hentriacontane | 31 | 68.0 |
| n-dotriacontane | 32 | 70.0 |
| n-tritriacontane | 33 | 71.0 |
| n-tetratriacontane | 34 | 72.9 |
| n-hexatriacontane | 36 | 76.1 |

In addition to the hydrocarbons listed here, other paraffinic hydrocarbons having a greater (or lesser) number of carbon atoms having a higher (or lower) melting point can also be employed in practicing the invention. Additionally, plastic crystals such as 2,2-dimethyl-1,3-propanediol (DMP) and 2-hydroxymethyl-2-methyl-1,3-propanediol (HMP) and the like are also contemplated for use as the temperature stabilizing means. When plastic crystals absorb thermal energy, the molecular structure is modified without leaving the solid phase.

Combinations of any phase change materials can also be utilized. Microencapsulated phase change material (MicroPCM) is desirably distributed homogeneously throughout the polymeric binder. In some embodiments, the MicroPCM can be predispersed in water using a dispersing agent, for example, Dispex™ A40 before being mixed with latex binder. According to such embodiments, it is preferable that the phase change material is dispersed in the water at between about 30% and about 60% by weight of the solid material to the water, or preferably between about 40% and 45%. When a water/MicroPCM mixture is desirably made, preferably, the water/MicroPCM mixture is mixed with the latex binder to give a ratio of MicroPCM to rubber or between about 0.5 and 2 to 1. Preferably, the dry binder to base nonwoven material ratio is between about 0.3:1 and 3:1. The preferred ratio depends on the required properties of the finished product. For a cushion insole, the ratio is preferably between about 0.3 and 0.5 to 1. For a lining material, the ratio is preferably about 1:1 and for a stiff insole, the ratio is preferably about 2.5:1. Optionally, the binder mix may include a coloring agent.

Examples of phase change materials are paraffinic hydrocarbons, namely normal (straight-chain) hydrocarbons represented by the formula CnH2n+2, wherein n can range from 10 to 30. Preferred paraffinic hydrocarbons are those in which n ranges from 13 to 28. Other compounds which are suitable for phase change materials are 2,2-dimethyl-1,3-propanediol (DMP), 2-hydroxymethyl-2-methyl-1,3-propanediol (HMP) and similar compounds. Also useful are fatty esters such as methyl palmitate. Preferred phase change materials are paraffinic hydrocarbons.

The thermal control properties can be made reversible for the textiles disclosed herein by providing for regeneration of the phase change material. During warming, for example, the phase change material gradually melts; during cooling, the phase change material gradually freezes. One way to regenerate the phase change material is to place the nonwoven in an environment having a temperature which restores the phase change material to the appropriate phase for the protection desired.

For most embodiments, the melting point or activation temperature of the phase change material is in the range of from about 15 to about 55° C. (60 to 130° F.), advantageously in the range 26 to 38° C. (80 to 100° F.). For most applications the activation temperature is preferably about 28° C. (83° F.). Advantageously, different grades of phase change material can be used for different applications. For example, it may be advantageous to have a higher activation temperature for shoe insoles of about 35° C. (95° F.), and a lower activation temperature of about 28° C. (83° F.) for upper or tongue areas of shoes. The variations in activation temperature can be selected to allow for the physical differences in the skin from the bottom of the foot to the top of the foot.

The specifications of thermal control materials as discussed herein can vary according to the uses to which they are put. The weight of the web can be from about 15 to about 1000 g/m2, preferably from about 40 to about 700 g/m2, or from about 50 to about 150 g/m2.

For example, when used as an interlining or as insulative materials for garments or footwear, the weight of the fibrous web can range from about 15 to about 200 g/m2, preferably from about 50 to about 160 g/m2. Such a web can be loaded with from about 5 to about 600 g/m2 of binder and phase change material, preferably from about 50 to about 450 g/m2 of binder and phase change material. The thickness of the nonwoven can range from about 0.5 mm up to about 20 mm when used as an interlining, or for garments and footwear. Preferably for a shoe insole or lining material, the initial thickness is between about 0.5 and 5 mm, whereas for a cushion insole, the initial thickness is between about 5 and 15 mm.

The invention further provides a method of manufacturing a shoe insole or lining material comprising the steps of 1) mixing a microencapsulated phase change material comprising a material having reversible thermal energy storage properties encapsulated in microcapsules of a retaining polymer and having an activation temperature of around body temperature (where body temperature is normal physiological skin temperature), with a liquid polymer binder; 2) impregnating a non-woven base material with the binder mixture; and 3) drying the impregnated material. Preferably the method further includes the step of pre-dispersing the microencapsulated phase change material in water before mixing with the liquid polymer binder. Preferably, the microencapsulated phase change material is pre-dispersed in water using a dispersing agent such as Dispex™ A40. Preferably, the method further includes the step of adding a thickening agent to the binder mix. It has been found that increasing the velocity of the mix improves stability, reduces separation of filtering out of the microcapsules during impregnation and results in a much better appearance of the finished material. Preferably, the impregnated material is dried at about 120° C. Preferably, the method includes the further step of curing the polymer binder material. Advantageously, the curing step is carried out at about 140° C. Preferably, the method includes the further step of finishing the material, for example, by calendaring the material to the required gauge, sueding the surface of the nonwoven lining and the application of adhesive or barrier coatings to aid the shoe-making process.

The invention further provides a shoe insole, comprising a nonwoven base material, a polymer binder, and a microencapsulated phase change material dispersed within the binder, wherein the phase change material comprises a material having reversible thermal energy storage properties encapsulated in microcapsules of a retaining polymer and the phase change material has an activation temperature of around body temperature.

The invention will be further described in the following examples, which do not limit the scope of the invention described in the claims.

EXAMPLES

Example 1

Preparation of a Nonwoven

A bat or web having a weight of 50 g/m$^2$ was carded from a mixture of 100% polyester fibers including fibers with 1.7 dtex and a length of 38 mm and 3.3 dtex and a length of 38 mm. The bat was submerged into a binder bath and dried in a dryer at 160° C., so that the resulting product had a weight of 111 g/m$^2$ containing 61 g/m$^2$ binder and phase change material. Thus, the product had 15 g/m$^2$ of dry mass of a self crosslinking acrylate binder with a glass temperature Tg=−10° C. and 46 g/m$^2$ phase change material (Thermasorb® 83 Frisby Technologies) wherein the weight ratio of binder to phase change material was 1:3.1 and the weight ratio of bat or web to binder plus phase change material is 1:1.2.

Example 2

Preparation of a Further Nonwoven

A bat or web having a weight of 110 g/m$^2$ was made from a mixture of 50% polyesterfibers with 1.7 dtex and a length of 38 mm and 50% polyamide 6.6 fibers with 3.3 dtex and a length of 38 mm was prebonded by needle punching. The bat was submerged into a binder bath and dried in a dryer at 165° C. so that the resulting product had a weight of 289 g/m$^2$ and contained 179 g/m$^2$ binder and phase change material. Thus, the product had 30 g/m$^2$ in the dry mass of a self crosslinking acrylate binder with glass temperature Tg=−32° C. and 149 g/m$^2$ phase change material (Thermasorb® 83 Frisby Technologies) wherein the weight ratio of binder to phase change material is 1:4.9 and the weight ratio of bat or web to binder plus phase change material is 1:1.6.

Example 3

Preparation of Yet a Further Nonwoven

A bat or web having a weight of 75 g/m$^2$ was made from a mixture of 90% polyesterfibers with 1.7 dtex and a length of 50 mm and 10% of a bicomponent fiber including polyamide 6.6 and polyamide 6 with 3.3 dtex and a length of 50 mm was prebonded by thermal bonding in a vacuum oven at 205° C. The bat was submerged into a binder bath as in Example 2 and dried in a dryer at 165° C. so that the resulting product had a weight of 237 g/m$^2$ wherein the weight ratio of binder to phase change material is 1:4.9 and the weight ratio of bat or web to binder plus phase change material is 1:2.2.

Example 4

Preparation of a Nonwoven Suitable for Use as a Shoe Insole Material

A non-woven needle felt of a blend of polyester fibers suitable for use as a shoe insole, such as for example the felt designated T90 as manufactured by Texon (UK) Limited, was impregnated with a water-based latex binder. The binder comprised the following composition by weight:

| | | |
|---|---|---|
| Thermasorb ™ microcapsules | 90 | pre-dispersion solid content of 45% |
| Dispex ™ A40 | 0.9 | |
| Water | 109 | |
| Applied Polymers S30R | 100 | |
| Synthomer ™ 7050 | 33 | |
| Coloring agent | 15 | |
| Ammonia | 1.5 | |
| 10% Viscalex ™ HV30 | 25 | |

This gives a Thermasorb™ to rubber content of 1.25:1 and a solids content of 43.2%.

A mat of polyester needle felt 40 cm×14 cm and having a thickness of 4.0 mm was impregnated with the binder mixture with a ratio of dry binder to felt of 1.70:1. The resulting impregnated material was dried at 120° C. and cured at 140° C. The final material had a weight of 1850 g/m2 and gauge of 4.2 mm and a Thermasorb™ content of 22% or 400 g/m2. This material could provide an energy storage capability of about 49 to 50 joules per grain, which can provide a cooling or warming effect when used as a shoe insole.

Example 5

Preparation of a Nonwoven Suitable for Use as a Cushion Shoe Insole Material

A non-woven needle felt of coarse polyester fibers suitable for use as a cushion insole for a shoe, such as for example the felt designated T100 as manufactured by Texon (UK) Limited, was impregnated with a water-based latex binder. The binder comprised the following composition by weight:

| | | |
|---|---|---|
| Thermasorb ™ microcapsules | 90 | pre-dispersion solid content of 45% |
| Dispex ™ A40 | 0.9 | |
| Water | 109 | |
| Latex 2890 | 200 | |
| Coloring agent | 15 | |
| Ammonia | 1.5 | |
| 10% Viscalex ™ HV30 | 25 | |

This gives a Thermasorb™ to rubber content of 1.13:1 and a solids content of 38.5%.

A mat of felt 40 cm×14 cm and having a thickness of 4.0 mm was impregnated with the binder mixture with a ratio of dry binder to felt of 1.50:1. The resulting impregnated material was dried at 120° C. and cured are 140° C. The final material had a weight of 900 g/m2 and gauge of 4.0 mm and a Thermasorb™ content of 23% or 200 g/m2. This material could provide an energy storage capability of about 57 to 58 joules per gram, which can provide a cooling or warming effect when used as a shoe insole. Test results on samples prepared according to examples 4 and 5 indicate that the shoe insole and lining materials according to the invention provide a noticeable cooling or warming effect when used within a shoe.

OTHER EMBODIMENTS

It is to be understood that while the invention has been described in conjunction with the detailed description thereof, the forgoing description is intended to illustrate and not limit the scope of the invention, which is defined by the scope of the appended claims. Other aspects, advantages, and modifications are within the scope of the following claims.

What is claimed is:

1. A method for preparing a nonwoven fabric impregnated with thermal control material wherein the nonwoven fabric is suitable for use as a shoe insole, lining or interlining, comprising:

preparing a loose fibrous bat or web containing fiber intersections and interstices, submerging the web in a bath comprising a dispersed mixture of polymeric binder and microcapsules containing phase-change thermal control material, removing the web from the bath, and drying the web to create a nonwoven fabric with phase-change thermal control material dispersed therein, wherein the phase-change thermal control material is dispersed in the binder and the binder acts as a bonding agent of the web to itself as well as the bonding agent of the microcapsules of phase-change thermal control material to each other and to the web, and wherein at least a part of the interstices is filled with gas which imparts thermal insulative properties to the web, and wherein the thickness of the nonwoven fabric after drying is in the range of 0.5 mm to 15 mm.

2. The method according to claim 1 wherein the web is formed from at least one fiber prepared by continuous extrusion of a melted polymer.

3. The method of claim 1 wherein said dispersed mixture is a latex.

4. The method of claim 1 wherein said polymeric binder is selected from the group consisting of acrylic polymers, methacrylic polymers, vinyl alcohol polymers, styrene/butadiene copolymers, ethylene/vinyl acetate copolymers, chloroprene rubbers, nitrile rubbers, and mixtures of the foregoing.

5. The method of claim 4 wherein said dispersed mixture is a latex.

6. The method of claim 1 wherein the weight ratio of fibrous web to polymeric binder and thermal control material is in the range of 1:0.5 to 1:3.

7. The method of claim 6 wherein the weight ratio of polymeric binder to thermal control material is in the range of 1:3.1 to 1:4.9.

8. The method of claim 1 wherein the weight ratio of polymeric binder to thermal control material is in the range 1:0.5 to 1:6.

9. The method of claim 1 wherein the weight of the web prior to submerging the web in the bath is in the range of 15 to 200 g/m$^2$.

10. The method of claim 9 wherein the fibrous web is prepared from fibers of 0.5 to 30 denier, and the bath is prepared utilizing microcapsules having diameters of 15 to 200 microns.

11. The method of claim 10 wherein the nonwoven fabric contains a combined weight of polymeric binder and phase-change thermal control material is in the range of 50-600 $g/m^2$.

12. The method of claim 1 wherein the nonwoven fabric contains a combined weight of polymeric binder and phase-change thermal control material is in the range of 50-600 g/m2.

13. A method for preparing a shoe insole or lining, said insole or lining comprising a nonwoven fabric impregnated with thermal control material, the method comprising:

preparing a loose fibrous bat or web containing fiber intersections and interstices, submerging the web in a bath comprising a dispersed mixture of polymeric binder and microcapsules containing phase-change thermal control material, removing the web from the bath, and drying the web to create a nonwoven fabric with phase-change thermal control material dispersed therein, wherein the phase-change thermal control material is dispersed in the binder and the binder acts as a bonding agent of the web to itself as well as the bonding agent of the microcapsules of phase-change thermal control material to each other and to the web, and wherein at least a part of the interstices is filled with gas which imparts thermal insulative properties to the web, and wherein the thickness of the nonwoven fabric after drying is in the range of 0.5 mm to 15 mm.

14. The method according to claim 13 wherein the web is formed from at least one fiber prepared by continuous extrusion of a melted polymer.

15. The method of claim 13 wherein said dispersed mixture is a latex.

16. The method of claim 13 wherein said polymeric binder is selected from the group consisting of acrylic polymers, methacrylic polymers, vinyl alcohol polymers, styrene/butadiene copolymers, ethylene/vinyl acetate copolymers, chloroprene rubbers, nitrile rubbers, and mixtures of the foregoing.

17. The method of claim 13 wherein the weight ratio of fibrous web to polymeric binder and thermal control material is in the range of 1:0.5 to 1:3.

18. The method of claim 17 wherein the weight ratio of polymeric binder to thermal control material is in the range of 1:3.1 to 1:4.9.

19. The method of claim 13 wherein the weight ratio of polymeric binder to thermal control material is in the range 1:0.5 to 1:6.

20. The method of claim 13 wherein the weight of the web prior to submerging the web in the bath is in the range of 15 to 200 $g/m^2$.

21. The method of claim 19 wherein the fibrous web is prepared from fibers of 0.5 to 30 denier, and the bath is prepared utilizing microcapsules having diameters of 15 to 200 microns.

22. The method of claim 13 wherein the nonwoven fabric contains a combined weight of polymeric binder and phase-change thermal control material in the range of 50-600 g/m2.

* * * * *